US009920496B2

(12) United States Patent
Ummenhofer et al.

(10) Patent No.: US 9,920,496 B2
(45) Date of Patent: Mar. 20, 2018

(54) PISTE GROOMING VEHICLE AND CLEARING BLADE FOR A PISTE GROOMING VEHICLE OF THIS TYPE

(71) Applicant: KÄSSBOHRER GELÄNDEFAHRZEUG AG, Laupheim (DE)

(72) Inventors: Gerhard Ummenhofer, Bad Schussenried (DE); Dieter Hann, Senden (DE); Sven Holzapfel, Ulm (DE)

(73) Assignee: KAESSBOHRER GELAENDEFAHRZEUG AG, Laupheim (DE)

( * ) Notice: Subject to any disclaimer, the term of this patent is extended or adjusted under 35 U.S.C. 154(b) by 0 days.

(21) Appl. No.: 15/104,078

(22) PCT Filed: Dec. 5, 2014

(86) PCT No.: PCT/EP2014/076759

§ 371 (c)(1),
(2) Date: Jun. 13, 2016

(87) PCT Pub. No.: WO2015/091030

PCT Pub. Date: Jun. 25, 2015

(65) Prior Publication Data

US 2016/0312421 A1 Oct. 27, 2016

(30) Foreign Application Priority Data

Dec. 20, 2013 (DE) ..... 10 2013 226 923
Jan. 20, 2014 (DE) ..... 10 2014 200 899

(51) Int. Cl.
*E01H 4/00* (2006.01)
*E01H 4/02* (2006.01)

(52) U.S. Cl.
CPC ..... *E01H 4/02* (2013.01); *E01H 2004/026* (2013.01)

(58) Field of Classification Search
CPC ..... E01H 4/02; E01H 5/00; E01H 2004/026; G05G 9/047
(Continued)

(56) References Cited

U.S. PATENT DOCUMENTS 4,462,172 A 7/1984 Caron
6,354,023 B1 3/2002 Trahan et al.
(Continued)

FOREIGN PATENT DOCUMENTS

CA 2210539 A1 7/1996
CA 2 355 057 A1 6/2000
(Continued)

OTHER PUBLICATIONS

International Search Report issued in Application No. PCT/EP2014/076759 with English translation, dated May 26, 2015 (8 pages).
(Continued)

*Primary Examiner* — Robert E Pezzuto
(74) *Attorney, Agent, or Firm* — Flynn, Thiel, Boutell & Tanis, P.C.

(57) ABSTRACT

Piste grooming vehicle and clearing blade for a piste grooming vehicle. The piste grooming vehicle has a clearing blade arranged at the front and includes a middle part and two side parts swivellably movable relative to the middle part, a setting arrangement for adjusting the middle part and/or the side parts and at least one manually operable actuating element arranged inside a cab for operating the setting arrangement. An electronic control unit is connected between the actuating element and the setting arrangement and operates the setting arrangement with a timed sequence of control commands for achieving at least one control
(Continued)

function for the side parts and/or the middle part from an initial position to an end position preset by the control function.

19 Claims, 3 Drawing Sheets

(58) Field of Classification Search
USPC ..... 37/219, 196, 234, 382, 412–416, 466, 37/236, 245, 247; 172/2–11, 123; 701/50
See application file for complete search history.

(56) References Cited

U.S. PATENT DOCUMENTS

| | | | | |
|---|---|---|---|---|
| 6,371,214 | B1 | 4/2002 | Anwar et al. | |
| 6,412,199 | B1 | 7/2002 | Quenzi et al. | |
| 6,810,609 | B2 * | 11/2004 | Lassonde | E01H 4/02 172/123 |
| 7,730,644 | B2 | 6/2010 | Frey et al. | |
| 2009/0105911 | A1 | 4/2009 | Okeson et al. | |

FOREIGN PATENT DOCUMENTS

| | | |
|---|---|---|
| DE | 295 00 818.0 | 4/1995 |
| WO | WO 01/44582 A1 | 6/2001 |

OTHER PUBLICATIONS

Office Action of German Patent Office issued in Application No. 10 2014 200 899.9 dated Sep. 3, 2014 (7 pages).
Office Action of Canadian Patent Office issued in Application No. 2 933 242 dated May 19, 2017 (4 pages).

* cited by examiner 1
4
5
6
11
12
13
14
IV
V

PISTE GROOMING VEHICLE AND CLEARING BLADE FOR A PISTE GROOMING VEHICLE OF THIS TYPE

FIELD OF THE INVENTION

The invention relates to a piste grooming vehicle having a clearing blade arranged at the front and comprising a middle part and two side parts swivellably movable relative to said middle part, and having setting means for adjusting the middle part and/or the side parts, and having at least one manually operable actuating element arranged inside a cab for operating said setting means, and a clearing blade for a piste grooming vehicle of this type.

BACKGROUND OF THE INVENTION

A piste grooming vehicle of this type is known in the form of the "PistenBully 600" of the applicant. The known piste grooming vehicle has at the front a three-part clearing blade comprising a middle part and two side parts each mounted swivellably movable relative to the middle part at opposite sides about a vertical axis. The clearing blade is detachably fastened to a front carrier, which is adjustable with the aid of hydraulic setting means such that the clearing blade can be lifted, lowered, tilted and angled. The two side parts are swivelled relative to the middle part using hydraulic setting means assigned to the clearing blade. For operating the hydraulic setting means and accordingly for adjusting the clearing blade, electrohydraulic actuators are provided that are operated from the cab using an actuating element in the form of a joystick. The movement of the clearing blade with its middle part and side parts is achieved by appropriate shifting and holding of the joystick by the driver of the piste grooming vehicle. Operation is relatively complex and requires skill and concentration from the driver of the piste grooming vehicle when operating the joystick.

SUMMARY OF THE INVENTION

The object of the invention is to provide a piste grooming vehicle and a clearing blade of the type mentioned at the outset that permits simplified operation by a driver of the piste grooming vehicle.

This object is attained for the piste grooming vehicle in that an electronic control unit is connected between the actuating element and the setting means and can be activated by the actuating element and in the activated state operates the setting means with a timed sequence of control commands for achieving at least one control function for the side parts and/or the middle part from an initial position to an end position preset by the control function. Thanks to the solution in accordance with the invention, an operator no longer has to keep the actuating element permanently pressed or adjusted between an initial position of the setting means for the middle part and/or the side parts until a required end position is reached. Instead, at least one control function is already programmed in the electronic control unit, which automatically performs, depending on the time and/or travel, an adjustment of the setting means between an initial position and a required end position, without the operator having to perform a control operation with the actuating element. The actuating element is instead used only to initiate the control function by the electronic control unit. The corresponding programmed sequence of control commands is performed automatically in the manner of a macrogenerator by the corresponding programmed control function. A pushbutton can be provided on the joystick inside the cab as an actuating element and can trigger the corresponding control function in the electronic control unit. The joystick can be used during performance of the at least one control function to control other operating functions of the piste grooming vehicle.

In an embodiment of the invention, several different control functions are stored in the electronic control unit and can be activated alternatively or cumulatively using the at least one actuating element. Preferred control functions are, in particular when a piste grooming vehicle is used for recreation park landscaping, movement of the middle part and the side parts into snow clearing positions, into smoothing, cutting and shaping positions, or also into raised rest positions if the clearing blade is not needed. To activate different control functions, either the actuating element can be operated in different ways by pressing it several times or similar, or several actuating elements are provided for activating different control functions.

In a further embodiment of the invention, the at least one control function in the electronic control unit is system-implemented. With this embodiment, one or more control functions for the clearing blade are already installed by the manufacturer. These are advantageously standard functions needed for the typical use of a clearing blade in a piste grooming vehicle.

In a further embodiment of the invention, the control unit is assigned an input unit using which the at least one control function can be programmed by the operator. This allows an operator of a piste grooming vehicle to make individual settings for required control functions of the clearing blade of his piste grooming vehicle.

In a further embodiment of the invention, at least one setting means is assigned a travel sensor unit to record the setting data of the setting means and transmit it to the control unit. In a further embodiment of the invention, at least one side part is assigned an angle sensor unit to record the angle data and transmit it to the control unit. The angle sensor unit preferably records angle settings of the at least one side part relative to the middle part. The angle sensor unit is preferably arranged in the area of the swivel mounting of the respective side part on the middle part.

In a further embodiment of the invention, the control unit regulates the setting means using the at least one control function depending on recorded travel and/or angle signals from the travel and/or angle sensors. Control of this type permits an improved accuracy of the control functions for the clearing blade, and hence particularly exact initial and end positions of the clearing blade depending on the respective control function. This allows a further improvement in the grooming work on snow surfaces in recreation parks, on halfpipes, ski pistes, footpaths and cross-country ski trails.

In a further embodiment of the invention, the at least one control function is visualized in a display inside a cab of the piste grooming vehicle. On the one hand this assures for a driver of the piste grooming vehicle a simple and visualized selection of a required control function, and on the other hand, the driver also receives a clear acknowledgement of the set control function. The actuating element can also be assigned to a touchscreen inside the cab, on which the corresponding control function is already visualized. Thanks to simple operation of the touchscreen, the electric control unit can be activated to initiate the required control function.

In a further embodiment of the invention, the setting means are of the hydraulic type. Corresponding single-acting or double-acting hydraulic cylinders are provided as hydraulic setting means. The hydraulic setting means are particularly suitable for transmitting the relatively high forces from the snow surface grooming work. Instead of hydraulic setting means, it is generally speaking also possible to provide electric or pneumatic setting means. The hydraulic setting means are operated by electrohydraulic actuators, which are in turn operated by the electronic control unit.

For the clearing blade of the type mentioned at the outset, the object underlying the invention is achieved in that a side contour of each side part is designed such that it forms in a clearing position a straight cutting edge over its entire height. This permits the cutting of particularly exact and straight contours in the snow to be groomed. This can be used in a particularly advantageous way during recreation park landscaping by a piste grooming vehicle provided with a clearing blade of this type. The straight cutting edge runs in the clearing position, in which the respective side part is set forwards at an angle relative to the middle part, in an advantageous manner—relative to a local coordinate system of the clearing blade—in a vertical direction of the clearing blade as long as the clearing blade is in the horizontal position.

The object underlying the clearing blade of the type mentioned at the outset is also achieved in that the middle part is provided in the area of a lower rear edge facing the cab with a rearward-projecting cutting and shaping profile that extends over an entire length of the middle part. The solution in accordance with the invention permits shaping, scraping, compacting or cutting of the snow surface even during reverse movement of the piste grooming vehicle. This solution too can be used in a particularly advantageous way for a piste grooming vehicle adapted to the requirements of recreation park landscaping.

In an embodiment of the invention, the side parts are provided in the area of a lower rear edge facing the cab with a rearward-projecting cutting and shaping profile which is continued when the side parts are in a position flush with the middle part in a line to the cutting and shaping profile of the middle part. This provides, during reverse movement of a corresponding piste grooming vehicle, the entire width of the clearing blade, including the middle part and side parts, for the required grooming work on the snow surface. The side parts and the middle part can be aligned in a common plane flush with one another such that the rear edges of the side parts and of the middle part too are aligned flush with one another in a straight line. The cutting and shaping profiles of the middle part and the side parts can be formed by ridges or cutting edges that are continuous over the entire length. Alternatively, it is also possible to provide the cutting and shaping profiles with wavy or tooth-row profiles or similarly designed alternating profiles.

Further advantages and features of the invention are obtained from the claims and from the following description of a preferred embodiment of the invention, shown on the basis of the exemplary drawings.

DETAILED DESCRIPTION

Figure 1:
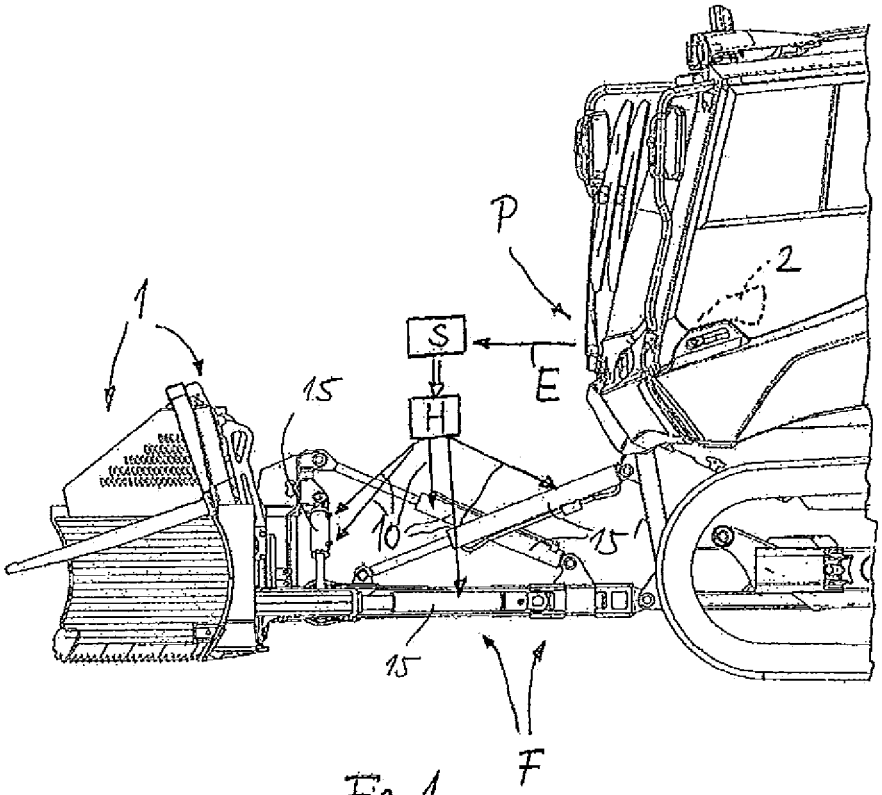
FIG. 1 shows a side view of a front part of an embodiment of a piste grooming vehicle in accordance with the invention.

A piste grooming vehicle P for recreation park landscaping has in accordance with FIGS. 1 to 6 a clearing blade 1. The clearing blade 1 comprises a middle part 4 and two side parts 5 mounted swivellably movable on the middle part 4 on opposite sides. The side parts 5 are each mounted swivellably movable on the middle part 4 about a swivel axis extending in the vertical direction of the clearing blade 1. The piste grooming vehicle P itself has a front carrier F for holding the clearing blade 1, to which carrier the middle part 4 of the clearing blade 1 is detachably fastened using a suspension device 13. The front carrier F can, using hydraulic setting means 15 in the form of single-acting or double-acting hydraulic cylinders, be lifted, lowered, tilted upwards or downwards relative to a transverse vehicle axis, swivelled about a central longitudinal vehicle axis or set at an angle about a vertical vehicle axis. The clearing blade 1 is, in the fitted state, firmly connected to the front carrier F such that an adjustment of the front carrier F automatically effects a corresponding adjustment of the clearing blade 1. The clearing blade 1 has two further hydraulic setting means 6 in the form of double-acting hydraulic cylinders used for operating the side parts 5. A hydraulic setting means 6 extends on each side between a corresponding pivot on the middle part 4 and an arm on the side part 5. The hydraulic setting means 6 in the form of the hydraulic cylinder is provided with two connections for corresponding hydraulic lines in order to permit a hydraulic pressure application both for retraction and for extension of the hydraulic cylinder. This is understood under the double-acting hydraulic cylinder. With a single-acting hydraulic cylinder, only the extension direction or the retraction direction is subjected to pressure. The opposite movement direction of the hydraulic cylinder is then achieved by simply releasing the hydraulic cylinder.

Figure 2:
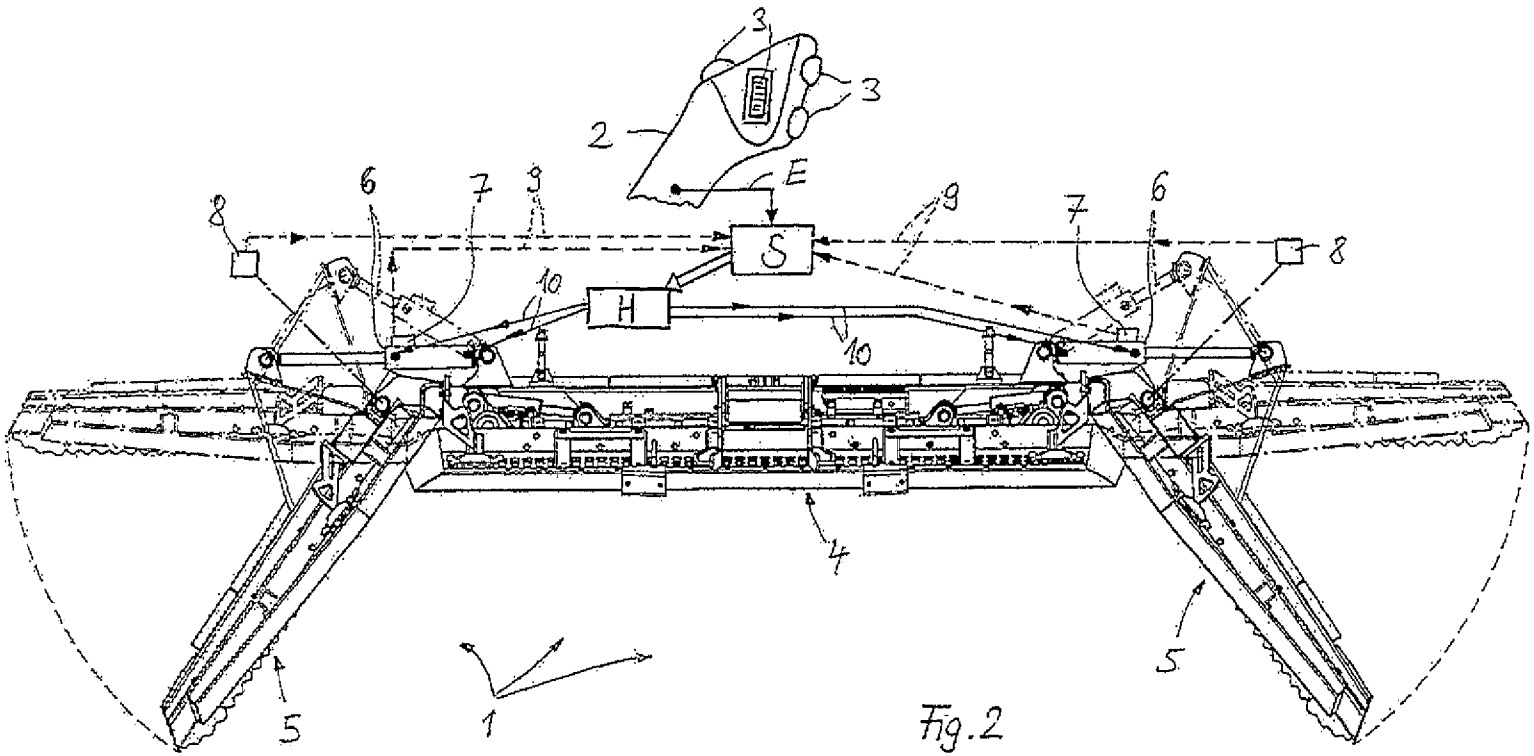
FIG. 2 shows schematically in a plan view an embodiment of a clearing blade in accordance with the invention for the embodiment of the piste grooming vehicle in accordance with the invention according to FIG. 1, FIG. 3 a front view of the clearing blade according to FIG. 2, FIG. 4 a plan view of the clearing blade according to FIG. 3 in a functional position differing from that shown according to FIG. 2, FIG. 5 a cross-section through the clearing blade according to FIG. 3 along the section line IV-IV and FIG. 6 an enlarged view of a portion V of the section according to FIG. 5.

Both the hydraulic setting means 6 for the side parts 5 and the hydraulic setting means 15 for adjusting the front carrier F of the piste grooming vehicle P, to which the clearing blade 1 is fastened, are operated by electrohydraulic actuators H (FIG. 1), of which in FIG. 2 only an electrohydraulic block operating the hydraulic setting means 6 for the side parts 5 is shown. The electrohydraulic actuators H are connected via hydraulic lines 10 to the hydraulic setting means 6, 15. The electrohydraulic actuators H are controlled by an electronic control unit S (FIGS. 1 and 2) that can be activated via at least one control line E by at least one actuating element 3 of a joystick 2 inside a cab of the piste grooming vehicle P. The corresponding actuating element 3 is operated by a driver or another operator of the piste grooming vehicle P to trigger a required control function of the electronic control unit S by a corresponding control signal via the control line E.

The electronic control unit forms an electronic control device having at least one microprocessor which is part of an operating system of said electric control unit S. In the electronic control unit S, several control functions for adjusting the middle part 4 and/or the side parts 5 are programmed and each effect an operation of the hydraulic setting means 15 of the front carrier F and/or of the hydraulic setting means 6 for the side parts 5 between an initial position and a required end position. Both initial and end positions do not necessarily correspond to the mechanically required end stops of the hydraulic setting means 6, 15 of the front carrier F and of the side parts 5. Instead, the initial and end positions correspond to defined positions of the clearing blade 1, in which advantageous grooming functions of the clearing blade 1 are achieved, such as a snow clearing function, a shaping and cutting function for recreation park structures during forward or reverse movement of the piste grooming vehicle P, or transitions to rest or transport positions of the clearing blade 1. A corresponding control function is triggered in simple manner by an operator in that the corresponding actuating element 3 in the form of a key or button is briefly operated, as a result of which the corresponding control function is activated via the control line E in the electronic control unit S and then proceeds in accordance with its programming. Corresponding control functions can already be implemented in the operating system of the electronic control unit S by the manufacturer. Supplementing this, an input unit can be connected to the electronic control unit S, using which individual control functions can be programmed by the user.

To permit an even more exact operation of initial and end positions of the side parts 5 relative to the middle part 4, the hydraulic setting means 6 according to FIG. 2 are assigned travel sensors 7, which are connected to the electronic control unit S via signal lines 9. Also, each swivel hinge of each side part 5 relative to the middle part 4 is assigned an angle sensor unit 8 which is likewise connected to the electronic control unit S via a signal line 9. Using the correspondingly recorded travel or angle signals, the electronic control unit S can effect regulation of the hydraulic setting means 6 in that actual values arriving via the signal lines 9 are compared with the set travel or angle values stored in the electronic control unit S and the electrohydraulic actuators H are operated depending on these set/actual value comparisons. This permits regulation of the adjustment of the side parts 5 relative to the middle part 4. In the same way, the hydraulic setting means 15 too are assigned travel sensors and/or moving parts of the front carrier F are assigned angle sensors in order to permit similar regulation by the control unit also in respect of all main function positions of the front carrier F. It is important to note that for operating the hydraulic setting means only one sensor unit is needed in each case, i.e. an angle sensor or a travel sensor unit, since signals of one sensor are sufficient for determining with sufficient precision the adjustment travel of the respective hydraulic setting means.

Figures 3, 4, 5, 6:
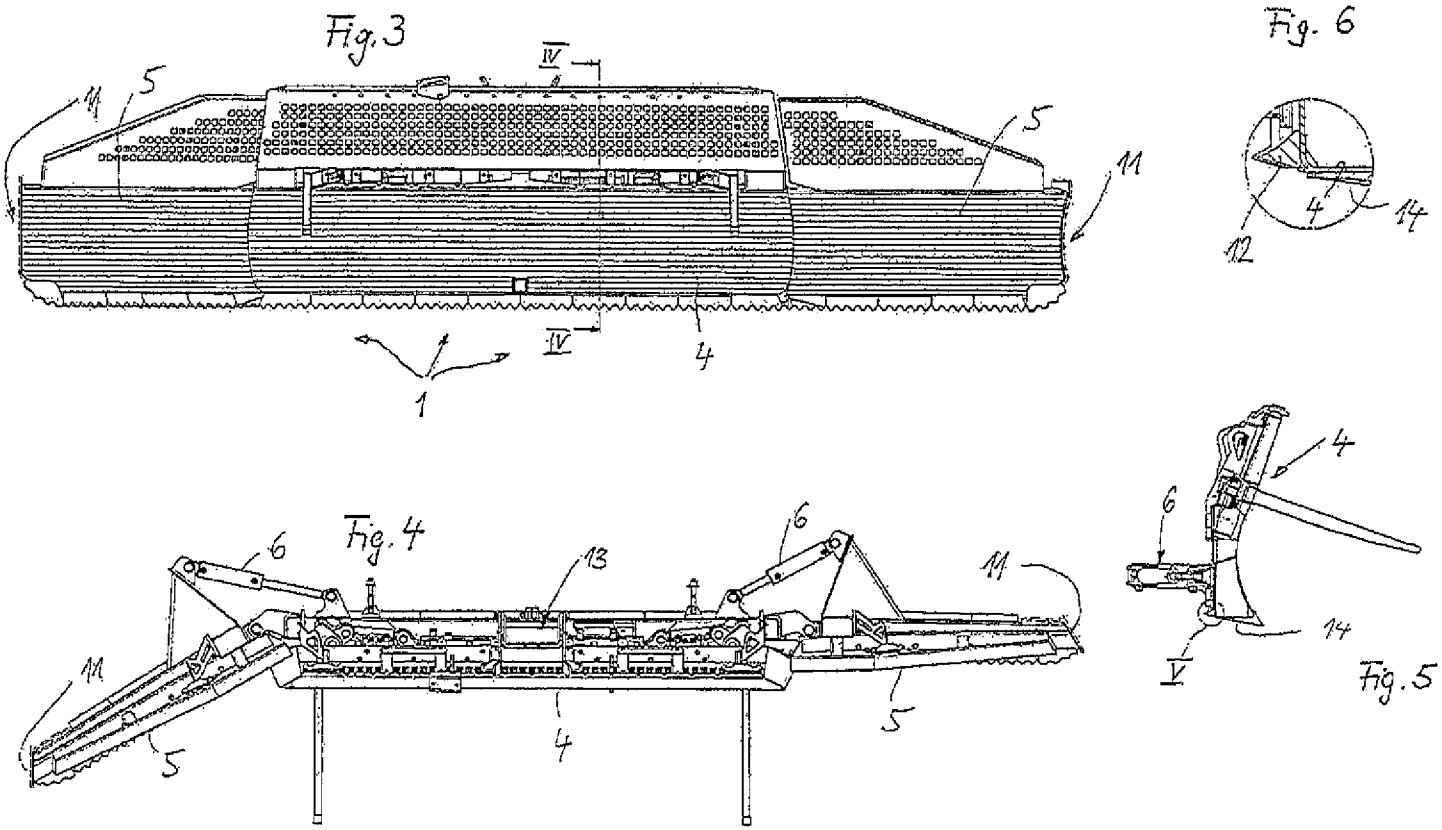

As can be discerned from FIGS. 2 to 5, the two side parts 5 are each provided at their side contours, positioned on the outside relative to the middle part 4, with a cutting edge 11, which in a clearing position of the side part 5 relative to the middle part 4 (see in FIG. 3 the left-hand side part 5) forms a cutting contour 11 aligned exactly vertical and straight in the vertical direction of the clearing blade 1. Since each side part 5 has a concave contour when viewed over its height, the result in a linear position of the side part 5 flush with the middle part 4 in one plane (see right-hand side part 5 in FIG. 4) is a concave side contour through the cutting edge 11. The front view of the clearing blade 1 according to FIG. 3 corresponds exactly to the position of the side parts 5 relative to the middle part 4, as is shown in FIG. 4.

The middle part 4 of the clearing blade 1 also has, as can be discerned from FIGS. 5 and 6, in the area of its underside a plane shaping surface 14, which is continued towards the rear of the middle part 4, i.e. to that side facing the front carrier of the piste grooming vehicle in the fitted state of the clearing blade 1, in a shaping and cutting profile 12 whose underside extends substantially flush with the shaping surface 14 of the middle part 4. The shaping surface 14 extends in one plane over the entire width of the clearing blade 1, but can however be profiled in itself in order to achieve uniformly profiled marking of the groomed and flat snow surface. Between the underside plane of the shaping surface 14 of the middle part 4 and the underside plane of the shaping and cutting profile 12, a shallow angle is provided, since during a forward movement of the piste grooming vehicle only the shaping surface 14 of the clearing blade 1 is to be in contact with the snow, in order to prevent skidding of the clearing blade due to an excessively large contact area. During a reverse movement, by contrast, only the cutting/shaping profile 12 should contact the snow surface. These functions are achieved thanks to the shallow angle between these underside planes. The shaping and cutting profile 12 is, as can be discerned from FIG. 5, designed wedge-shaped and forms at its rear edge a cutting edge or cutting tip. The shaping and cutting profile 12 thus formed on the rear underside of the middle part 4 permits cutting and shaping of the corresponding snow surface during reverse movement of the piste grooming vehicle. The shaping surface 14 is also used to compact and press smooth the snow surface groomed by the cutting and shaping profile 12.

The clearing blade 1 according to FIGS. 3 to 6 also has in the area of the side parts 5 on a rear bottom edge similar shaping and cutting profiles 12 which in the flush linear position of the side parts 5 are flush with the shaping and cutting profile 12 of the middle part 4. As a result, snow surface grooming by the rear bottom edge of the clearing blade 1 can be achieved over the entire width of the clearing blade 1 during reverse movement of the piste grooming vehicle.

The invention claimed is:

1. A piste grooming vehicle having a clearing blade arranged at a front thereof, the clearing blade comprising a middle part and two side parts swivellably movable relative to said middle part, and having setting means for adjusting at least one of the middle part and the side parts, and having at least one manually operable actuating element arranged inside a cab for operating said setting means, wherein an electronic control unit is connected between the at least one actuating element and the setting means and can be activated by the at least one actuating element and after activation operates the setting means with a timed sequence of control commands for achieving at least one control function for at least one of the side parts and the middle part from an initial position to an end position preset by the at least one control function.

2. The piste grooming vehicle according to claim 1, wherein several different control functions are stored in the electronic control unit and can be activated alternatively or cumulatively using the at least one actuating element.

3. The piste grooming vehicle according to claim 1, wherein the at least one control function in the electronic control unit is system-implemented.

4. The piste grooming vehicle according to claim 1, wherein the control unit is assigned an input unit for programming the at least one control function.

5. The piste grooming vehicle according to claim 1, wherein the setting means is assigned a travel sensor unit to record setting data of said setting means and transmit the setting data to the control unit.

6. The piste grooming vehicle according to claim 5, wherein at least one of the side parts is assigned an angle sensor unit to record angle data and transmit the angle data to the control unit.

7. The piste grooming vehicle according to claim 6, wherein the control unit regulates the setting means using the at least one control function depending on at least one of a recorded travel signal and an angle signal from at least one of the travel sensor unit and the angle sensor unit.

8. The piste grooming vehicle according to claim 1, wherein the at least one control function is visualized in a display inside the cab of the piste grooming vehicle.

9. The piste grooming vehicle according to claim 1, wherein the setting means are hydraulic.

10. A clearing blade for a piste grooming vehicle comprising a middle part and two side parts swivellably movable relative to said middle part, and having setting means for adjusting at least one of the middle part and the side parts, and having at least one manually operable actuating element arranged inside a cab for operating said setting means, wherein a side contour of each of the side parts is designed such that each of the side parts forms in a clearing position a straight cutting edge over an entire height thereof.

11. The clearing blade according to claim 10, wherein the middle part is provided in an area of a lower rear edge facing the cab with a rearward-projecting cutting and shaping profile that extends over an entire length of the middle part.

12. The clearing blade according to claim 10, wherein the side parts are each provided in an area of a lower rear edge facing the cab with a rearward-projecting cutting and shaping profile which is continued when the side parts are in a position flush with the middle part in a line to the cutting and shaping profile of the middle part.

13. The piste grooming vehicle according to claim 1, wherein a side contour of each of the side parts is designed such that each of the side parts forms in a clearing position a straight cutting edge over an entire height thereof.

14. The piste grooming vehicle according to claim 13, wherein the middle part is provided in an area of a lower rear edge facing the cab with a rearward-projecting cutting and shaping profile that extends over an entire length of the middle part.

15. A piste grooming vehicle comprising:

a cab; and a clearing blade arranged at a front of the cab;

the clearing blade comprising a middle part and two side parts movable relative to the middle part;

an adjustment assembly for adjusting positions of the middle part and the side parts;

at least one manually operable actuating element inside of the cab for operating the adjustment assembly; and an electronic control unit connected between the at least one manually operable actuating element and the adjustment assembly;

the electronic control unit being activated by a single manual actuation of one of the at least one manually operable actuating element;

activation of the electronic control unit causes the adjustment assembly to automatically move at least one of the middle part and the side parts from an initial position to an end position;

wherein movement of the at least one of the middle part and the side parts from the initial position to the end position occurs automatically and independently of actuation of any other actuating element other than the one of the at least one manually operable actuating element, and movement of the at least one of the middle part and the side parts from the initial position to the end position occurs according to a sequence of control commands issued from the electronic control unit after the single manual actuation of the one of the at least one manually operable actuating element.

16. The piste grooming vehicle according to claim 15, further including a movable joystick inside of the cab, wherein the at least one manually operable actuating element comprises a plurality of manually operable actuating elements on the movable joystick.

17. The piste grooming vehicle according to claim 16, wherein the one of the at least one manually operable actuating element is a first one of the plurality of manually operable actuating elements, and movement of the at least one of the middle part and the side parts from the initial position to the end position occurs automatically and independently of movement of the joystick and automatically and independently of actuation of the any other of the plurality of manually operable actuating elements other than the first one of the plurality of manually operable actuating elements.

18. The piste grooming vehicle according to claim 15, wherein the sequence of control commands issued from the electronic control unit happens over a predetermined amount of time.

19. The piste grooming vehicle according to claim 15, wherein the sequence of control commands issued from the electronic control unit happens over a predetermined amount of travel of the vehicle.

* * * * *